United States Patent [19]

Estes

[11] 4,073,366

[45] Feb. 14, 1978

[54] DISPOSABLE NOISE REDUCING HEARING AID ATTACHMENT

[76] Inventor: Roger Q. Estes, c/o P. H. Shelledy, Esq., Peyton Bldg., Spokane, Wash. 99201

[21] Appl. No.: 708,316

[22] Filed: July 26, 1976

[51] Int. Cl.[2] ..... G10K 13/00; H04R 25/00

[52] U.S. Cl. ..... 181/158; 179/107 R; 179/180; 181/166

[58] Field of Search ..... 181/158, 166, 149, 175, 181/160; 179/180, 107 R

[56] References Cited

U.S. PATENT DOCUMENTS

| | | | |
|---|---|---|---|
| 1,851,208 | 3/1932 | Nicolson | 181/166 |
| 3,154,171 | 10/1964 | Knutson et al. | 181/158 |
| 3,265,153 | 8/1966 | Burroughs | 181/158 |
| 3,976,848 | 8/1976 | Estes | 181/166 |

*Primary Examiner*—Stephen J. Tomsky
*Attorney, Agent, or Firm*—Wells, St. John & Roberts

[57] ABSTRACT

A disposable noise reducing hearing attachment provided for covering the sound inlet of a hearing aid to reduce the amplitude of random noises such as wind noises and to prevent dirt and moisture from entering the sound inlet. The attachment includes a flexible open cellular noise filter that is covered by a thin sheet of tightly woven material to form a wind and dust screen on the top surface of the noise filter. A stretchable bottom ring layer of nonporous sheet material is attached to the bottom surface of the noise filter in which the bottom ring layer has an aperture that is greater than the cross section of the sound inlet. The top wind screen layer and the bottom ring layer are secured to opposite sides of the noise filter layer by rings of adhesive that have diameters greater than the cross-sectional diameter of the sound inlet of the hearing aid so that adhesive does not interfere with the sound transmission through the attachment and into the hearing aid through the sound inlet.

8 Claims, 4 Drawing Figures

FIG. 1
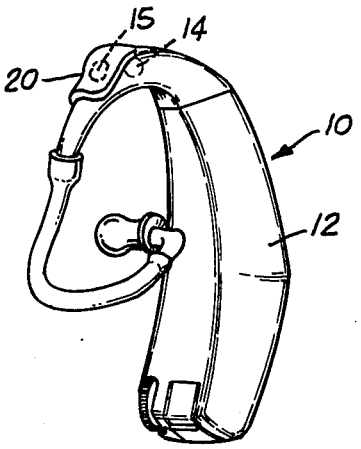
FIG. 2
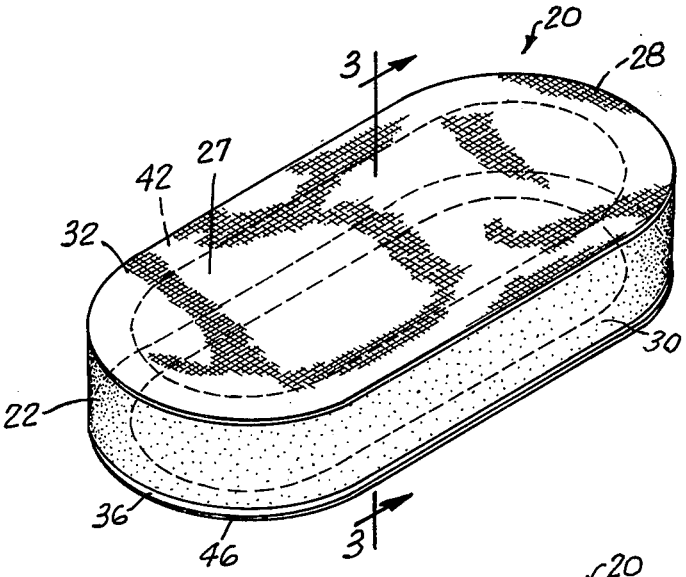
FIG. 3
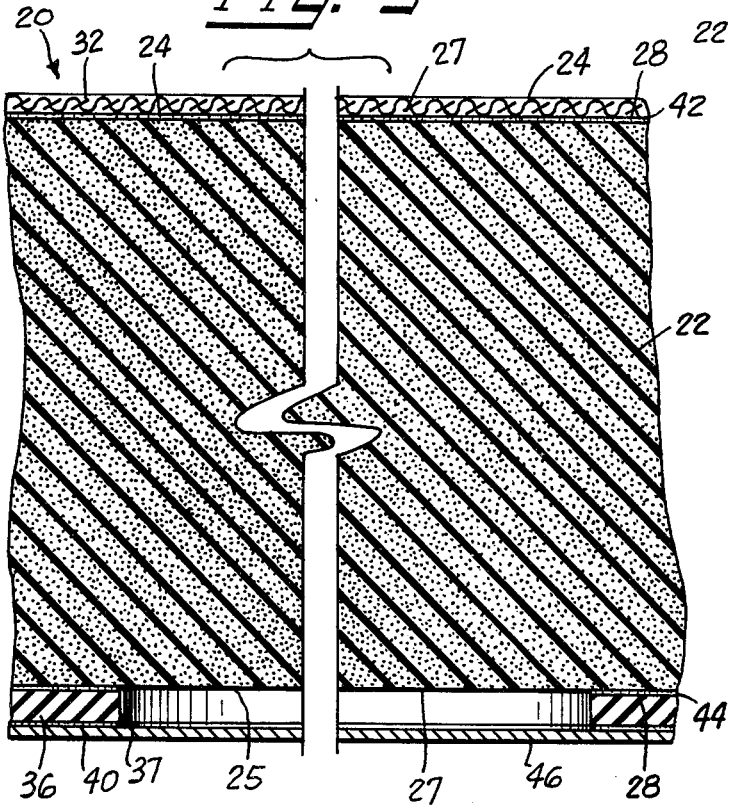
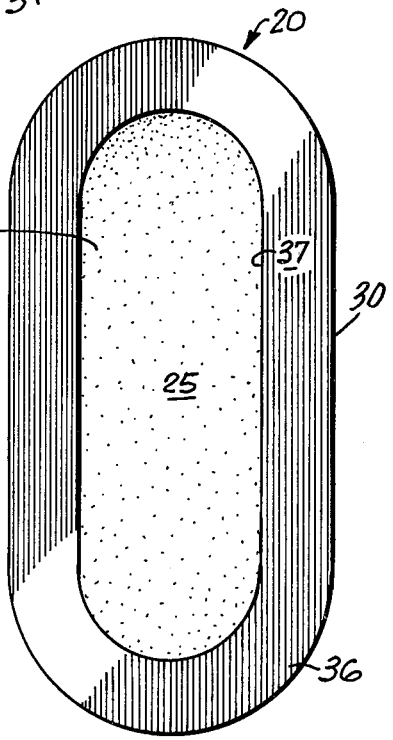
FIG. 4

DISPOSABLE NOISE REDUCING HEARING AID ATTACHMENT

BACKGROUND OF THE INVENTION

This invention relates to hearing aids and more particularly to attachments for hearing aids that cover the sound inlet of the hearing aid for reducing environmental noise and preventing dust and moisture from entering the hearing aid through the sound inlet.

Frequently when the hearing aid user is out of doors a breeze or wind creates an air velocity across the sound inlet of the hearing aid causing a whistling noise or "Coke-bottle" effect resulting in very annoying random noises to the hearing aid user. Additionally because of perspiration of the user and moisture conditions in the atmosphere, the sound inlet to the microphone of the hearing aid frequently becomes clogged or corroded requiring replacement of the hearing aid. Additionally dust and dirt migrate into the sound inlet causing degradation of the sound system.

Consequently, one of the principal objects of this invention is to provide an improved disposable noise reducing hearing aid attachment that is attachable to the hearing aid over the sound inlet to reduce the amplitude of audible noise particularly those noises caused by wind and to prevent dust and moisture from passing into the sound inlet of the hearing aid.

A further object of this invention is to provide a disposable hearing aid attachment that is very economical to manufacture and quite efficient in operation to reduce random wind noises from the sound system of hearing aids.

An additional object of this invention is to provide an improved disposable hearing aid attachment that may be easily attached by the user and disposably removable when replacement is desired.

A still further object of this invention is to provide an improved disposable hearing aid attachment for fitting over the sound inlet of a wide variety of hearing aid configurations.

An additional object of this invention is to provide a disposable hearing aid attachment for fitting over the sound inlet which is very effective in reducing the whistling noise of environmental air passing over the sound inlet while additionally preventing feedback noises from being generated by the attachment.

These and other objects and advantages of this invention will become apparent upon reading the following detailed description of a preferred and alternate embodiment.

BRIEF DESCRIPTION OF THE DRAWINGS

A preferred embodiment of this invention is illustrated in the attached drawing, in which:

FIG. 1 is a fragmentary side view of a portion of a typical hearing aid illustrating a disposable noise reducing hearing aid attachment covering a sound inlet of the hearing aid;

FIG. 2 is a perspective view of the disposable noise reducing hearing aid attachment;

FIG. 3 is a fragmentary cross-sectional view of the disposable noise reducing hearing aid attachment illustrated in FIG. 2; and FIG. 4 is a bottom view of the disposable noise reducing hearing aid attachment after a "peel stick" layer is removed.

DETAILED DESCRIPTION OF A PREFERRED EMBODIMENT

Referring in detail to the drawing, there is illustrated in FIG. 1 a hearing aid generally designated with the numeral 10. The hearing aid may be of various configurations, having a body or housing 12 with an internal microphone 14. The housing 12 is generally securable to the user. The housing 12 has a sound inlet 15 formed in the housing for transmitting audible sound from the environment to the internal microphone 14. The sound inlet 15 has a specified cross-sectional area.

This invention is concerned with a disposable noise reducing hearing aid attachment generally designated with the numeral 20 that is removably attachable to the hearing aid 10 overlying the sound inlet 15. The disposable hearing aid attachment is flexible so that it will so adjust to the various housing contours. Additionally the attachment 20 may be of various shapes and sizes, depending upon the type of hearing aid and the environment in which it is utilized.

As shown in FIG. 2, the attachment 20 includes a flexible noise filter layer 22 that is formed of an open cellular material that has a continuous porosity with the cells or interstices interconnected forming numerous random paths through which the sound may pass from the environment to the sound inlet 15. Preferably the open cellular material is formed of either urethane foam, polyvinyl foam or wool felt. Preferably the noise filter layer 22 has a thickness between a top surface 24 and a bottom surface 25 of between 3/32nds of an inch and $\frac{1}{8}$ of an inch. Preferably the layer has a density of between 1 $lb/ft^3$ and 2 $lb/ft^3$. The layer 22 is sufficiently porous and thin that it forms a translucent material. The surfaces 24 and 25 are quite fragile.

The flexible noise filter layer 22 has peripheral dimensions that are considerably greater than the cross-sectional area of the sound inlet 15 so that the flexible noise filter layer 22 will completely overlie the sound inlet 15 when the attachment 20 is applied to the hearing aid.

The top surface 24 and the bottom surface 25 each have a central region 27 that is considerably greater than the cross-sectional area of the sound inlet 15. The central region 27 is circumscribed by a perimeter region 28. The noise filter layer 22 has a peripheral edge 30 that defines the determination of the perimeter region 28.

The disposable noise reducing aid attachment 20 further includes a flexible wind and dust screen layer 32 that is mounted over the top surface 24 coextensive with the peripheral dimensions of the layer 22. The flexible wind and dust screen layer is constructed of a tightly woven fabric that covers and protects the open cells of the top surface 24 of the noise filter layer 22. The fibers of the screen layer 32 are sufficiently close to prevent dust and moisture from penetrating through the screen layer 32 to the filter layer 22. Additionally the screen layer 32 prevents air from passing transversely over the open cells of the top surface 24 to prevent each open cell from forming or producing a "Coke-bottle" effect. Additionally the screen layer 32 protects the open cellular noise filter layer 22 from being torn or damaged during handling or during the application of the attachment to the hearing aid. Additionally the screen layer 32 prevents the open cells of the top surface 24 from being clogged with dirt and moisture.

Preferably the screen layer 32 is constructed of fibers of nylon, silk or rayon acetate. Preferably the tightly woven screen layer 32 has a thread count of between 45 by 80 threads per inch and 90 by 160 threads per inch. The screen layer 32 has a peripheral edge that is substantially coextensive with the peripheral edge of layer 22.

The disposable noise reducing hearing aid attachment 20 further includes a stretchable bottom ring layer 36 that is formed of a flexible material that is additionally stretchable. The ring layer 36 has an aperture 37 formed therein that is substantially greater in cross-section that the sound inlet 15. The ring layer 36 is preferably formed of a natural or synthetic rubber-like material such as latex rubber or stretchable vinyl that has the capability of stretching longitudinally and transversely to accommodate the attachment 20 to the contour and surfaces of the hearing aid housing about the inlet 15. The layer 36 has a peripheral edge that is substantially coextensive with the peripheral edges of the layers 22 and 32.

The layer 36 has a bottom surface that is coated with a pressure sensitive adhesive coating 40 for enabling the attachment 22 to be releasably secured to the housing about the sound inlet 15. The pressure sensitive adhesive coating 40 may be of a commercial grade vinyl, butyral or acrylic adhesive available on the market that is sufficiently permanently tacky to bond the attachment 20 to the housing, yet will not leave an adhesive residue on the housing when the attachment 20 is removed. The pressure sensitive adhesive coating 40 must have sufficient adhesive strength to hold the attachment 20 firmly to the hearing aid. The stretchable ring layer 36 enables the attachment to be distorted somewhat to accommodate the attachment to the contours of the housing to enable the pressure sensitive adhesive to adequately temporarily bond the attachment to the material.

In the preferred embodiment the pressure sensitive adhesive coating 40 is protected prior to applying the attachment to the housing 12 by a slip sheet of waxed or silicone coated paper 46 (FIGS. 2 and 3) which may be pealed from the bottom of the attachment 10 to expose to pressure sensitive adhesive coating 40 at the time of application. The physical nature of the paper 46 is not particularly important except to serve as to protect the pressure sensitive coating 40 prior to applying the disposable noise reducing hearing aid attachment 20 to the hearing aid. FIG. 4 shows the bottom of the attachment 20 with the paper 46 removed.

The flexible wind and dust screen layer 32 and the stretchable bottom ring layer 36 are permanently secured to the top surface 24 and the bottom surface 25 of the filter layer 22 respectively by bands or rings 42 and 44 of adhesive. The adhesive rings 42 and 43 are applied in the perimeter region 28 of the filter layer 22. It is important that the central region 27 of the top surface 24 and the bottom surface 25 be free of any adhesive so as not to generate a feedback of the sound or a "ringing" of the sound when the attachment is applied to the hearing aid. It is very important that the sound transmitted through the central region 27 of the noise filter be uninterrupted by a nonporous coating or layer.

The applicant's invention has been perfected after extensive trial and error to obtain a disposable noise reducing hearing aid attachment 20 that is very effective in reducing many very annoying random noises, while preventing dust and moisture from entering the sound inlet 15.

The above described embodiment is simply illustrative of the principles of this invention and numerous other embodiments may be readily devised by those skilled in the art without deviating therefrom. Therefore only the following claims are intended to define this invention.

What is claimed is:

1. A disposable noise reducing hearing aid attachment for attaching to a hearing aid that has a housing with a sound inlet formed therein of a specified cross-sectional area to transmit audible sound from the environment to an internal microphone, comprising:

a flexible noise filter layer of an open cellular material for overlying the sound inlet to reduce the amplitude of audible noise transmitted from the environment to the hearing aid sound inlet;

said noise filter layer having extended top and bottom surfaces of greater area than the cross-sectional area of the sound inlet to form a central area region for directly overlying the sound inlet and a circumferential perimeter region for extending outward of the sound inlet;

a flexible wind and dust screen layer of tightly woven fabric coextensive with and engaging the top surface of the noise filter layer;

a stretchable bottom ring layer of sheet material having a central aperture of a cross-sectional area greater than the cross-sectional area of the sound inlet engaging the perimeter region of the bottom surface of the noise filter layer;

said screen layer and said stretchable ring layer being permanently secured to the perimeter regions of the respective top and bottom surfaces of the noise filter layer by rings of adhesive with the central area regions of the noise filter surfaces being free of adhesive;

said ring layer having a bottom surface with a coating of pressure sensitive adhesive thereon to enable the attachment to be releasably mounted to the hearing aid housing over the sound inlet.

2. The noise reducing hearing aid attachment as defined in claim 1 wherein the flexible noise filter layer is constructed of an open cellular felt material.

3. The noise reducing hearing aid attachment as defined in claim 1 wherein the flexible wind and dust screen is constructed of a tightly woven silk fabric.

4. The noise reducing hearing aid attachment as defined in claim 1 wherein the flexible noise filter layer is open cellular urethane foam having a thickness of between 3/32 inch and ⅛ inch and a density of between 1 $lb/ft^3$ and 2 $lb/ft^3$.

5. The noise reducing hearing aid attachment as defined in claim 1 wherein the flexible noise filter layer is constructed of an open cellular urethane foam material.

6. The noise reducing hearing aid attachment as defined in claim 1 wherein the flexible noise filter layer is constructed of an open cellular polyvinyl foam material.

7. The noise reducing hearing aid attachment as defined in claim 1 wherein the flexible wind and dust screen is constructed of a tightly woven nylon fabric.

8. The noise reducing hearing aid attachment as defined in claim 1 wherein the flexible wind and dust screen is constructed of a tightly woven rayon acetate.

* * * * *